US010271706B1

(12) United States Patent
Feeny

(10) Patent No.: US 10,271,706 B1
(45) Date of Patent: Apr. 30, 2019

(54) DEVICE FOR MOP HEADBAND

(71) Applicant: John Feeny, Troy, MI (US)

(72) Inventor: John Feeny, Troy, MI (US)

(73) Assignee: The Tuway American Group, Inc., Troy, MI (US)

( * ) Notice: Subject to any disclaimer, the term of this patent is extended or adjusted under 35 U.S.C. 154(b) by 776 days.

(21) Appl. No.: 14/304,851

(22) Filed: Jun. 13, 2014

Related U.S. Application Data

(60) Provisional application No. 61/834,784, filed on Jun. 13, 2013.

(51) Int. Cl.
*A47L 13/20* (2006.01)
*A47L 13/24* (2006.01)

(52) U.S. Cl.
CPC ..... *A47L 13/20* (2013.01); *A47L 13/24* (2013.01)

(58) Field of Classification Search
CPC ..... A47L 13/20; A47L 13/24
See application file for complete search history.

(56) References Cited

U.S. PATENT DOCUMENTS 4,530,130 A * 7/1985 Moss ..... A47L 13/24 15/145
2001/0052162 A1* 12/2001 Young ..... A47L 13/20 15/229.2

* cited by examiner

*Primary Examiner* — Randall Chin
(74) *Attorney, Agent, or Firm* — Young Basile Hanlon & MacFarlane, P.C.

(57) ABSTRACT

A mop device that includes a plurality of yarns collected in a bundle, the yearn bundle having a first end and an opposed second end; at least one headband connected to the yarn bundle at a location intermediate between the first end and the second end of the yarn bundle; at least one spacer member connected to the headband in overlying relationship thereto, the spacer member having a first face and an opposed second face, wherein the spacer member is in overlying relationship to the headband of the associated yarn bundle, and wherein the spacer member has at least one aperture extending from the first face to the second face configured to communicate with the associated headband. Also disclosed is the use of the spacer device alone and the mop device in combination with a mop handle member.

21 Claims, 10 Drawing Sheets

DEVICE FOR MOP HEADBAND

The present application is claims priority to U.S. Provisional Patent Application Ser. No. 61/834,784 filed Jun. 13, 2013, the specification of which is incorporated by reference herein.

BACKGROUND

The present invention pertains to mops and more particularly to mop headbands.

Mop headbands are used to bundle mop yarns into an efficient useful unit throughout the life of the mop unit. In certain applications, the mop unit is configured to be removably connected to a suitable mop handle. This facilitates removal for mop head laundering, transferring between different mop heads for different cleaning applications and the like. Mop heads can be configured to be grasped by a suitable mop handle attachment mechanism such as a gripper vise or other mechanism. These vise-like gripper mechanisms typically contact the mop head band in a manner that maximizes use of the associated mop yarns or other floor contacting cleaning mechanisms. Certain mop handle attachment mechanisms such as gripper vises do not adequately center or connect to the mop head band. This can compromise cleaning effectiveness and/or ergonomic efficiency and/or mop head lifespan. It would be desirable to provide a mop head that could provide increases in one or more of these areas. It would also be desirable to provide a device that could improve mop performance.

SUMMARY

A mop device that includes a plurality of yarns collected in a bundle. The yarn bundle has a first end and an opposed second end; and at least one headband connected to the yarn bundle at a location between the first end and the second end of the yarn bundle. The mop device has at least one spacer member connected to the headband in overlying relationship thereto. The spacer member has a first face and an opposed second face, such that, when the spacer member is in overlying relationship to the headband of the associated yarn bundle, the first face of the spacer member is in an orientation that is generally parallel to the headband. The spacer member has at least one aperture extending from the first face to the second face configured to communicate with the associated headband.

DESCRIPTION OF THE DRAWING

The present invention is described in the following detailed description. In order to further disclose and describe the invention, reference is made to the following drawing figures in which like reference numerals are used where appropriate to describe the various elements throughout the various drawing figures. It is to be understood that the various drawing figures are illustrative rather than limitative of the present invention.

DETAILED DESCRIPTION

Disclosed herein a device 10 that can be used with various mop connection members to orient and position elements of the respective mop connection member 12 that releasably connect between a mop strand bundle and the mop connection member 12

Figure 1:
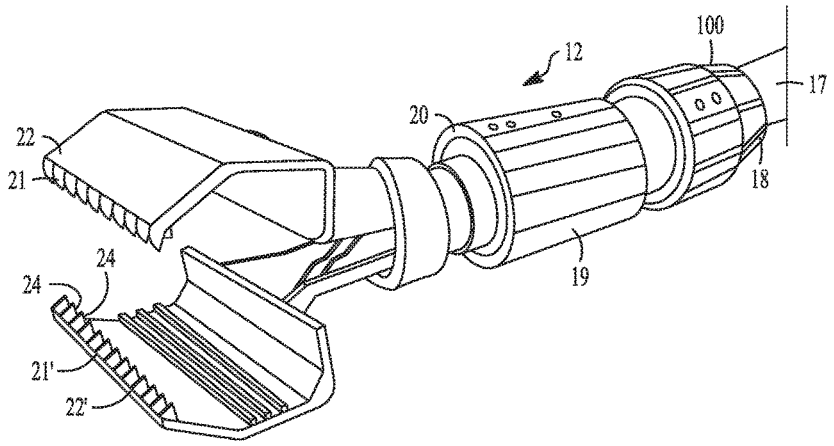
FIG. 1 is a perspective drawing of a representative mop connector device that can be employed in an embodiment of the invention as disclosed herein.

One representative embodiment of a suitable connection member 12 is depicted in the FIG. 1. The representative connection member 12 can include a central body shaft that has a first end 18 and an opposed second end 20. The first end 18 is connected to or is configured to be connected to an elongated mop handle member 17. At least one jaw member 22 extends outwardly from the opposed second end 20 of the connection member 12. The jaw member 22 can be in either fixed or pivotal relationship relative to the second end 20 of the connection member 12. In certain embodiments, the jaw member 22 can be configured to clampingly engage a mop head such as a mop head configured as a strand bundle in fixed relationship when the mop head is interposed between the jaw member 22 and a mating member such as jaw member 22'. It is contemplated that one or both jaw members 22, 22' can be pivotally mounted relative to the second end of the connection member 12. The connection member 12 can include suitable means for releasably maintaining the jaw members 22, 22' in fixed clamped relationship with one another. In various embodiments, this can be achieved by suitable telescopic member 19 that is engagement first ends of the respective members 22, 22'. An opposed second end 21, 21' of one or more of jaw members 22, 22' can be configured to releasably engage an associated mop strand bundle. In the embodiment depicted in FIG. 1, the opposed second end 21, 21' of one or both of the jaw members 22, 22' can be configured with teeth 24 configured to releasably engage the associated mop strand bundle.

Figure 3:
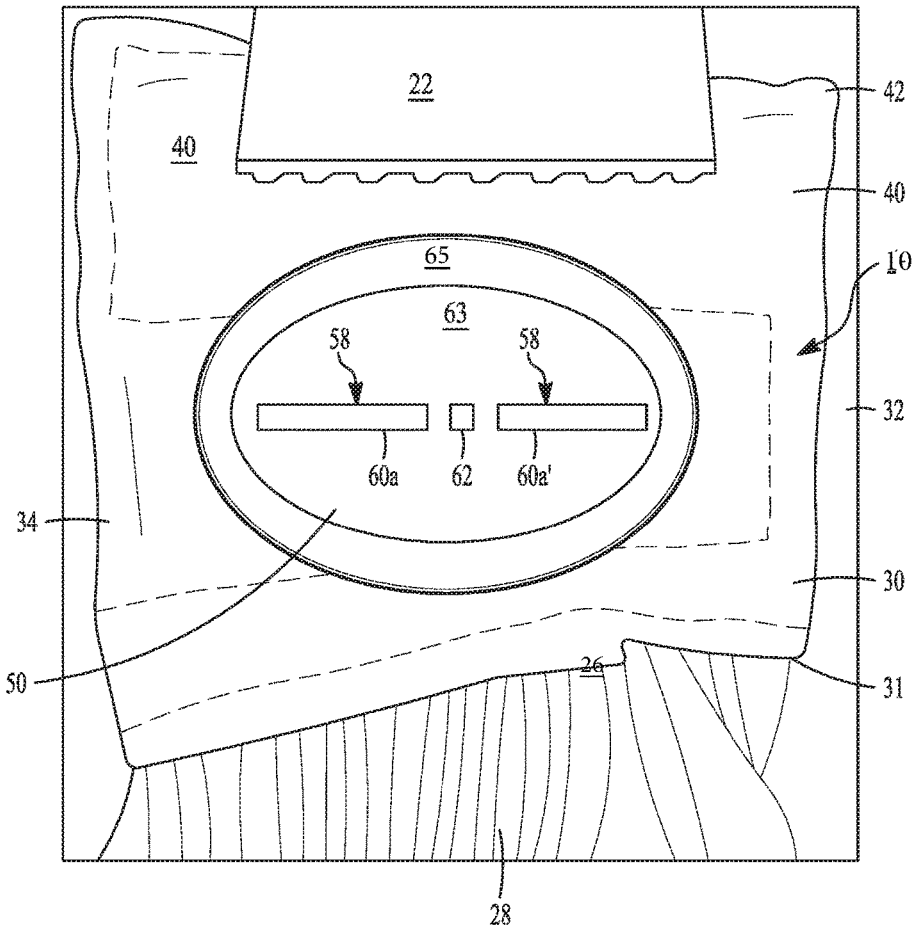
FIG. 3 is a detail view of second embodiment of the spacer member connected to a headband of a mop strand bundle.
Figure 19:
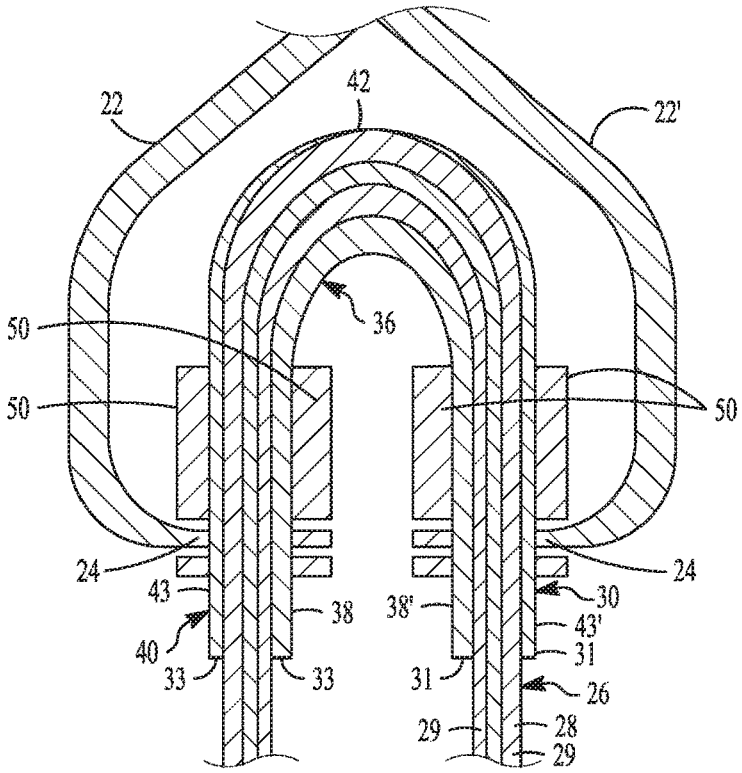
FIG. 19 is a cross-sectional view of a strand bundle that employs multiple spacer members in connection with a mop connector device.

It is contemplated that a suitably configured connection member 12 in engagement with a suitable mop strand bundle can form a mop assembly. Non-limiting examples of suitable mop strand bundles 26 are depicted in FIGS. 3 and 19. The mop portion of mop strand bundle 26 can be composed of a plurality of individual elongated yarns or strands 28 that are oriented lengthwise in an essentially parallel orientation.

The individual yarns or strands 28 may be positioned in a plurality of layers 29 in order to provide thickness and enhance utility of the strand bundle 26. Thus multiple layers 29 of yarns or strands 28 positioned side by side can be integrated in to the associated strand bundle 26. The individual yarns or strands 28 can be attached to each other to form a unit by employing suitable attachment mechanisms. In various embodiments the yarns or strands 28 can be stitched to one another to form an attachment configuration that is oriented essentially perpendicular to the orientation of the elongated individual yarns or strands 28. Non-limiting examples of suitable attachment configurations include direct stitching (not shown) and/or connection or affixing of the individual yarns or strands 28 into a suitable headband 30. Where desired or required, the resulting strand bundle 26 can employ both individual stitching and connection with a suitable headband 30. The headband 30, when in position on the strand bundle 26 can have two opposed sides 32, 34 as well as two opposed edges 31, 33. When in position on the strand bundle 26, the headband 30 can also define a first outwardly oriented face 36 and an opposed second outwardly oriented face 40.

The headband 30 can be of any suitable band width $B_w$, unit width $U_w$ and thickness T. Band width $B_w$ is measured along a plane that is generally parallel to that length defined by the longitudinal plane that is coplanar with the elongated yarns or strands 28 when the yarns strands are oriented in their parallel elongated positions and can be measured from edge 31 to edge 33. Unit width $U_W$ is defined as the width of the headband 30 as extending from side end 32 to side end 34 of the strand bundle 26. Thickness T is the measurement of the headband material from a first outwardly oriented face 36 of headband 30 to oppose outwardly oriented face 40. In various embodiments, the head band 30 has a bandwidth $B_w$ that can have a value that varies from less than 1" to 8" or greater depending on the associated strand bundle 26.

The headband 30 can be composed of various materials. However the primary material will be a 100% polyester material that has been sized for increased stiffness and strength. The strand bundle 26 may also include a single or double tailband as desired or required (not shown). The tailband can be made from various blends of materials; however, the preferred material will be a 100% polyester material.

The headband 30 can be oriented at any suitable location relative to the yarns or strands 28 in the strand bundle 26. In certain embodiments, the headband 30 can be located at one end of the parallel yarns or strands 28. In other embodiments, it is contemplated that the headband 30 can be more centrally located relative to the yarns or strands 28 such that the yarns or strands 28 can extend from either edge 31, 33 of headband 30. The headband 30 can have suitable bandwidth $B_W$ sufficient to permit the headband 30 to be doubled over itself as in manner depicted in FIG. 19. As illustrated in FIG. 19, one portion of the outer surface 36 of headband 30 overlies the other portion of the outer surface 36 to form inwardly oriented headband sections 38, 38'. Inwardly oriented headband portions 38, 38' can be disposed in generally parallel relationship to one another when in the strand bundle 26 is in the use position as illustrated in FIG. 19. The headband 30 also includes opposed outwardly oriented surface 40 that is generally opposed to first outwardly oriented surface 36. In the embodiment depicted in FIG. 19, the opposed headband surface 40 can form an outer U-shaped configuration that includes a central portion 42 and two arm sections 43, 43'. In certain embodiments, the doubled strand bundle 26 can be held in fixed relationship relative to the connection member 12 by engagement with and by jaw members 22, 22' such that the jaw members 22, 22' exert pressure on the associated headband 30.

In addition to having a plurality of strands or yarns 28 having terminal first and second ends that are collected into a bundle such as strand bundle 26 with at least one headband 30 connected to the strand bundle 26, the mop device 10 disclosed herein also includes at least one spacer member 50 that is positioned in overlying relationship with the headband 30.

In various embodiments, the at least one spacer member 50 can be held in attached contact relationship with the headband surface 40 at a generally central location relative to one of the two arm sections 43,43'. The spacer member 50 can be affixed to the head band 30 by any suitable manner including, but not limited to, pressure engagement attachment that is exerted by associated jaw members 22, 22' of the associated connection member 12. In various embodiments, it is also contemplated that the spacer member(s) 50 can be held in affixed engagement with the headband surface 40 of headband 30 by mechanisms including, but not limited to, adhesive fastening, mechanical fastening and the like. Mechanical fastening can include various clamps seams and the like.

Figure 2:
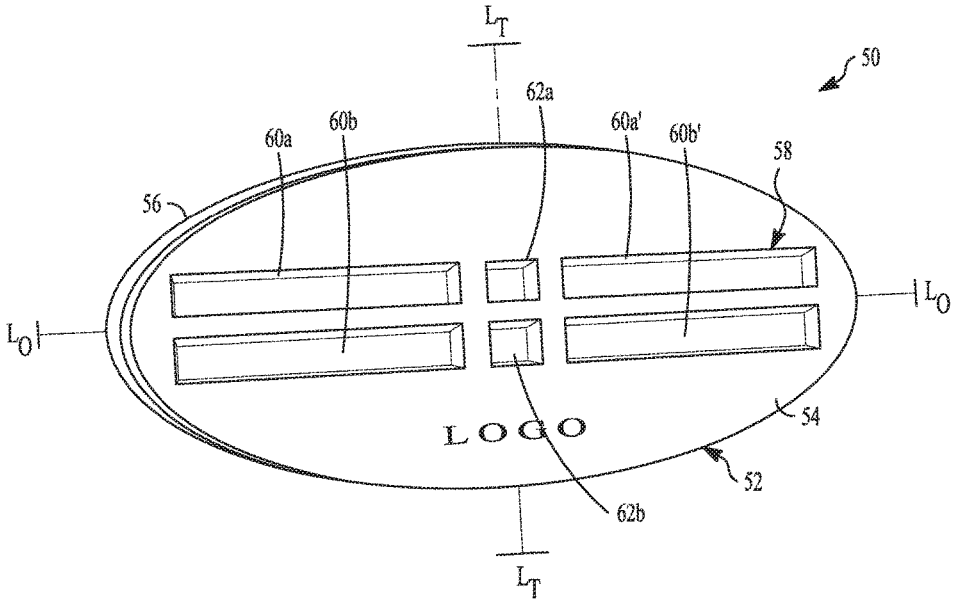
FIG. 2 is a perspective view of a first embodiment of a spacer member as disclosed herein.

Referring to FIG. 2, the spacer member 50 can have a central body 52 having a first outwardly oriented face 54 and an opposed inwardly oriented face 56. In the use position, the inwardly oriented face 56 is configured to contact the associated surface of the headband 30 of an associated strand bundle 26, such as the portion of outwardly oriented surface 40 that is located in one of arms 43, 43'. The spacer member 50 also includes at least one aperture 58 that extends from the first outwardly oriented face 54 and the opposed inwardly oriented face 56. In certain embodiments, it is contemplated that the at least one aperture 58 will be configured as an elongated slot.

In the embodiment depicted in FIG. 2, the central body 52 is a general planar member having generally in which the faces 54, 56 at least one face 54, 56 is planar. The first outwardly oriented face 54 can have a suitable surface area region 57 to permit suitable legend such as an indicia or advertisement to be imprinted or embossed thereon. The central body can have any suitable geometric configuration. In the embodiment illustrated FIG. 2, the central body 52 is generally elliptical or oval. Other configurations are also contemplated.

In embodiment depicted in FIG. 2, the spacer member 50 includes a plurality of apertures 58 that are disposed longitudinally relative to the central body such as the ellipse depicted in FIG. 2. In the embodiment depicted the plurality of apertures 58 include major slot apertures 60 and minor slot apertures 62. The major slot apertures 60 can be elongated rectangles while the minor slot apertures 62 can be configured as squares. As depicted, the major slot apertures 60 can present as a pair of apertures **60*a*, 60*a'* that are disposed in line with one another collinear to the longitudinal axis $L_O$. In the embodiment depicted in FIG. 2, the pair of major slot apertures 60***a*, 60*a*' can be linearly disposed relative to one another with minor slot aperture 62*a* positioned between major slot apertures 62*a*, 62*a*' as illustrated in FIG. 3. In the embodiment depicted in FIG. 2, the spacer member 50 has a pair of aperture configurations disposed parallel to one another and to longitudinal axis $L_O$ such that major slot aperture 60*a* is parallel to major slot aperture 60*b*; major slot aperture 60*a*' is disposed parallel to major slot aperture 60*b*'; and minor slot aperture 62*a* is disposed parallel to minor slot aperture 62*b*.

The at least one aperture 58 can be of any suitable configuration sufficient to removably receive the leading edge defined on the opposed second end 21, 21' of an associated jaw member such as members 22, 22' therein when the jaw members 22, 22' are in clamped orientation to one another. In certain embodiments, it is contemplated that the leading edge can include tooth members 24 defined in the associated jaw member 22 or 22' that can extend into the associated major or minor slot such that the ridge member from which the tooth member(s) 24 project can contact and engage the region of the spacer member 50 that is proximate to the associated aperture 58. In this manner, the pressure exerted by the clamped jaws 22, 22' is distributed to the spacer member 50 and the associated region of the headband 30 as well as transferring pressure through the respective aperture to the portion of the headband 30 that is contained by the respective aperture. One non-limiting example of such configuration where clamped jaws engage a spacer member 50 is depicted in FIG. 4.

Figure 4:
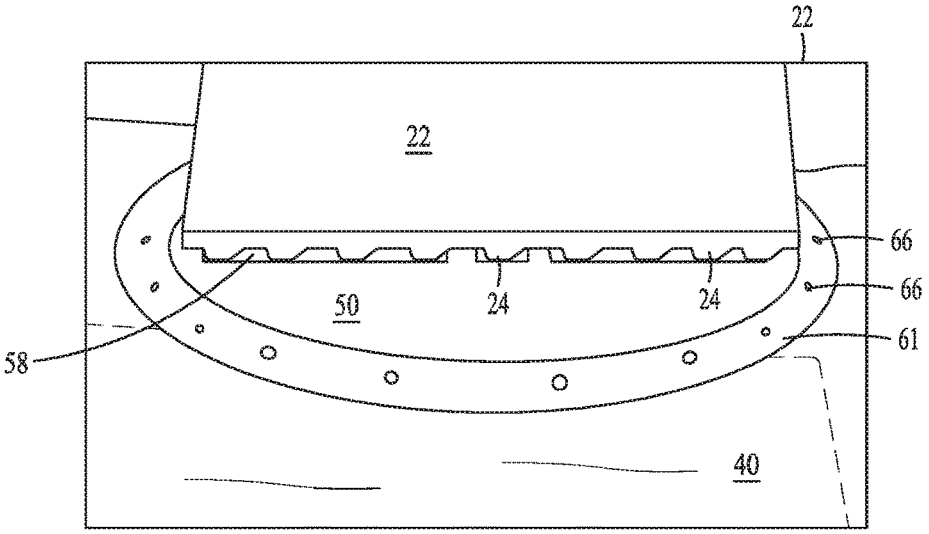
FIG. 4 is a detail view of the spacer member of FIG. 2 connected to a mop strand bundle with a representative mop connector device in engaged relationship.

It is also contemplated that the spacer member 50 can be configured with a single line of apertures 58 extending longitudinally relative to the ellipsoidal central body such as in the dash-dot-dash configuration defined in the member as illustrated in FIG. 3.

Where desired or required, the outwardly oriented face 54 can be configured with an elevated central region 63 as illustrated in FIGS. 3 and 4. The elevated central region 63 can be bordered by a perimeter edge region 65. The perimeter edge region can be configured to form a flange structure.

The spacer member 50 can be composed of one or more of several various material types. It is contemplated that the spacer member 50 can be formed of a suitable molded plastic compound.

This molded plastic spacer member 50 can be affixed to the canvas or mesh material in the headband 30. The process to affix this spacer member component can be done by using an adhesive material such as glue or hot melt adhesive, pressure or heat staking operations, mechanical locking/latch features, or a method of welding the spacer member component onto the material in the headband 30. In certain embodiments, it is contemplated that the chemical adhesive attachment can be accomplished using either permanent, semi-permanent, reusable or single-use material. It is also contemplated that the spacer member 50 can be attached using various mechanical fastening mechanisms. Non-limiting examples of such attachment mechanisms include spikes 64 which project outward from the inwardly oriented planar face 56 to a terminal location distal thereto. In the use position, the spikes 64 project into the material in the headband 30 and yarns or strands 28 in the strand bundle 26 proximate to the headband 30 and contained therein to further anchor the spacer device 50. The spikes 64 can be located at any suitable position relative to the central body 52 projecting from inwardly oriented planar face 56. In certain embodiments, a plurality of spikes 64 can be disposed around the perimeter of the central body 52. In the embodiment illustrated, the spacer member 50 has five spikes 64. It is contemplated that the attachment mechanism can include a combination or chemical and mechanical fastening mechanisms as desired or required.

Figure 6:
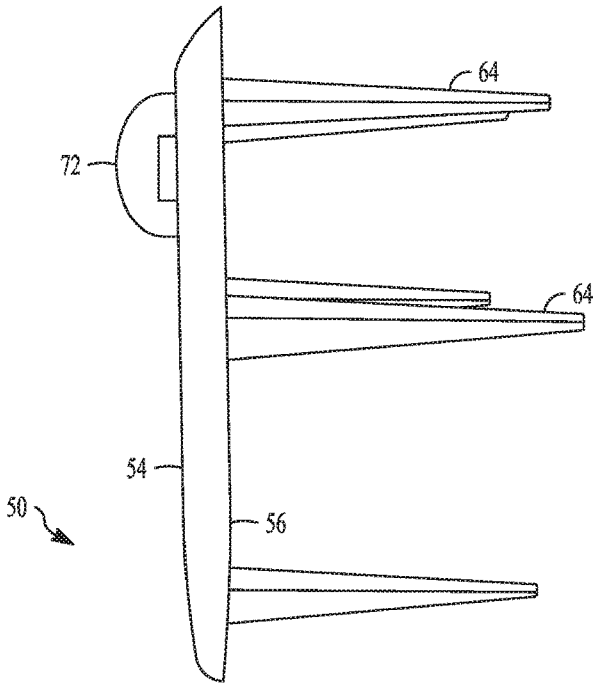
FIG. 6 is a side view of the embodiment of the spacer member of FIG. 5.

An alternate fastening mechanism can include mechanical stitching or sewing the spacer member 50 into fixed relationship to the associated headband 30. Where desired or required the central body 52 can be configured with suitable eyelets 66 defined therein, for example, around the perimeter of the central body 52. The eyelets 66 can be configured to accommodate various stitching, tacks or other fasteners as desired or required. As illustrated in FIG. 6, the eyelets 66 are located in perimeter edge region 65.

In certain embodiments, it is contemplated that the spacer member 50 can be contained within a suitable cloth or mesh sleeve (not shown) which itself can be suitably attached to the headband 30. Where desired or required, it is also contemplated that the spacer member may be positioned within the material that makes up headband 30.

It is contemplated that the mop device 10 can include one or more spacer members 50 that are affixed to the headband 30 of strand bundle 26. One such orientation for a mop device comprising more than one spacer member 50 is one in which the multiple spacer members 50 are positioned in stacked relationship to one another when in the use position as in the manner illustrated in FIG. 19. In the embodiment depicted in FIG. 19, four spacer members 50 are positioned on the headband 30 such that two of the spacer members 50 are connected to the inwardly oriented face 56 and two of the spacer members are connected to the outwardly oriented face 54. When the mop head 12 is in the use position, the headband 30 doubled across its width and the two spacer members 50 connected to the inwardly oriented face 56 can contact one another and the two spacer members 50 connected to the outwardly oriented face 54 are positioned such that their respective outer surfaces are oriented outward opposed to one another and are oriented such that they can be in contacted relationship with the respective jaws 22, 22'. In other embodiments, it is contemplated that the strand bundle can be configured with two spacer members 50 connected to the headband 30.

The spacer member 50 can be oriented in any axial direction which allows for optimum connection and performance of the device and associated mop assembly 10. In the embodiment depicted in the FIGS. 3 and 4, the various apertures 58 are centrally located. In the embodiment depicted in FIG. 19, the apertures 58 can be offset from center if desired or required.

Figure 5:
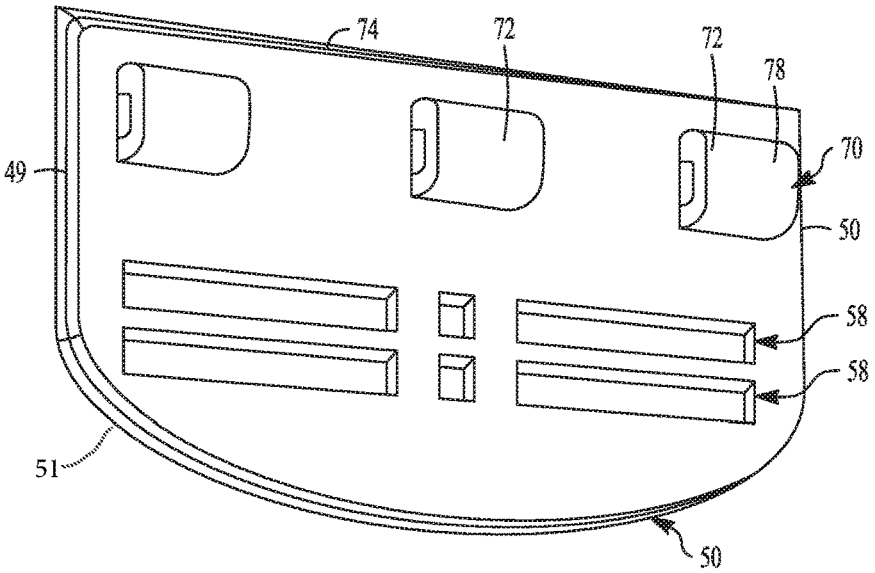
FIG. 5 is a perspective view of a third embodiment of the spacer member as disclosed herein.
Figure 7:
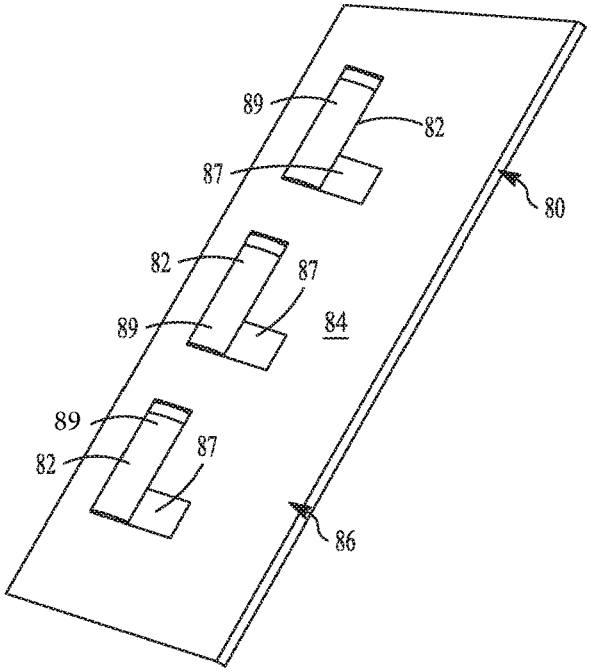
FIG. 7 is a perspective view of a first embodiment of an appliance attachment mechanism that can be used with various embodiments of the spacer member as disclosed herein.
Figure 8:
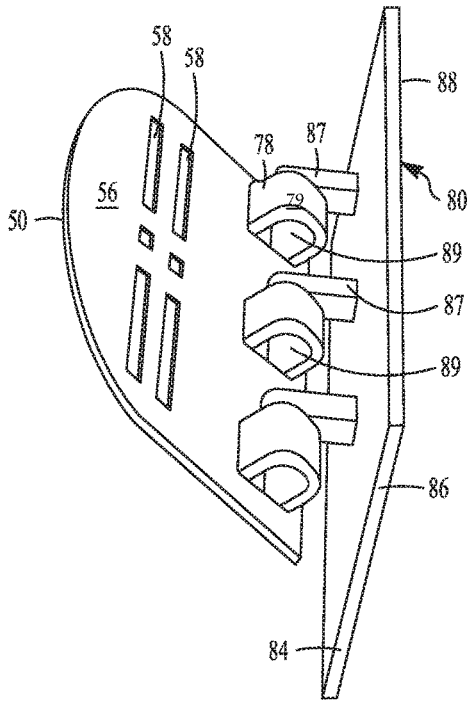
FIG. 8 is a perspective view of an embodiment of an assembly that includes an embodiment of spacer member as disclosed herein and an embodiment of the attachment mechanism as disclosed herein.

The spacer device 50 can also be configured with a rotational attachment member 70. The rotational attachment mechanism 70 is contiguously connected to and projects outward from the outwardly oriented face 54 of the central body 52 of the spacer member 50. In the embodiment depicted in FIG. 5, the spacer member 50 is configured as a generally rectilinear planar member having three straight edges 49 and an arcuate edge 51. The rotational attachment mechanism 70 is positioned proximate to one of the straight edges 49. The rotational attachment mechanism 70 as depicted in FIG. 5 includes a plurality of latch members 72 disposed along one of the three straight edges 49 such as attachment edge 74. As depicted, three latch members 72 are disposed parallel to the attachment edge 74 at a location between the attachment edge 74 and the aperture 58. The latch members 72 each have an interior slot configured to engage a mating member present on a suitable appliance mounting member; and example of which is illustrated in FIG. 7 and in FIG. 8 where the spacer member 50 of FIG. 5 is illustrated in engagement with appliance mounting member 80. Appliance mounting member 80 includes a plurality of mating members 82 projecting from a first face 84 of an appliance mounting body 86. It is contemplated that suitable appliances can be mounted to the second opposed face 88 of the mounting body. Non-limiting examples of such appliances can include scrubbing pads, abrasive members and the like.

The appliance mounting member 80 may also be rotational once affixed in its primary position relative to the spacer member 50 to allow for secondary rotational placement of the ancillary device being attached to the headband, such as a scrub brush, scrub pad or wiper such as a squeegee or other form of appliance that can provide scrubbing or wiping action. One embodiment of an engaged relationship between the two respective members is found in FIG. 8. The rotational attachment mechanism 70 of spacer member 50 includes three latch members 72 that project from outwardly oriented face 54. The latch members 72 are walls 78 that project outward from outwardly oriented surface 54 of the spacer member 50 and a appliance mounting member 80 connected to the distal ends of walls 78. The walls 78 and central member 79 of each latch member 72 define a channel. The mating members 82 defined on appliance mounting member 80 each include a pedestal 87 that projects outward from the face 84 of the appliance mounting member 80. A rod 89 is connected to the distal end of the pedestal 87 and is cantilevered therefrom in overlying relationship to the first face 84. The cantilevered rod 89 can be received in the channel defined in the latch member 72 present on spacer 50.

Figure 9:
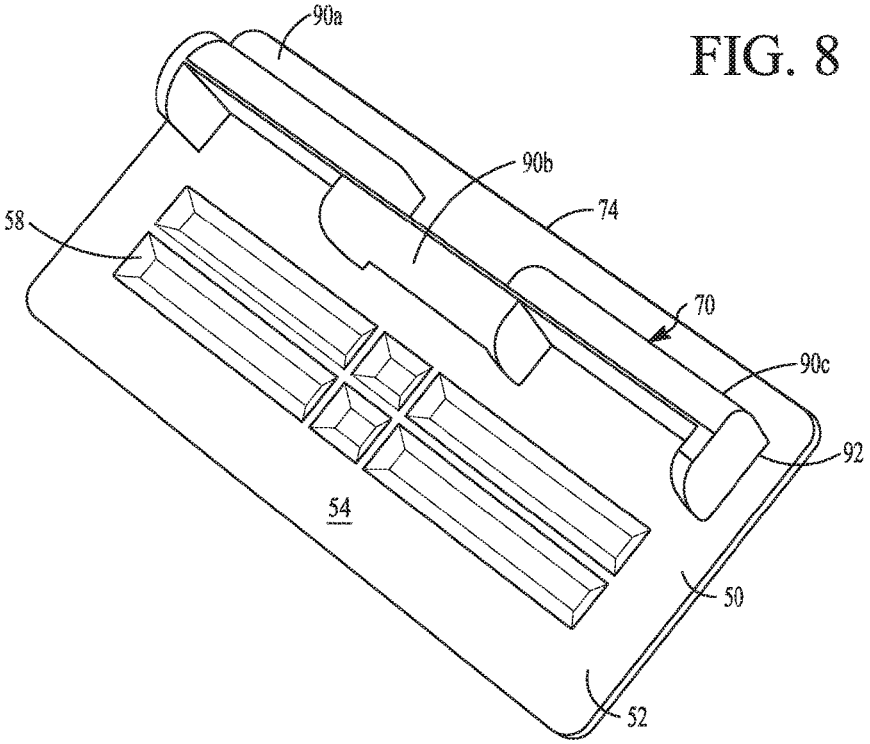
FIG. 9 is a perspective view of a fourth embodiment of the spacer member as disclosed herein.
Figure 10:
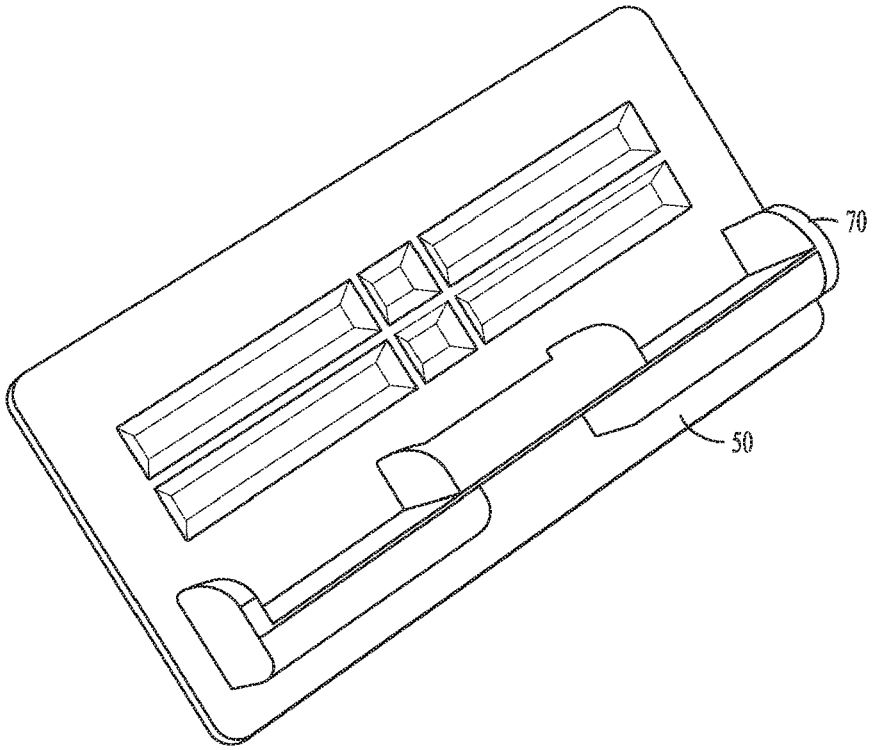
FIG. 10 is an alternate perspective view of the spacer member of FIG. 9.
Figure 11:
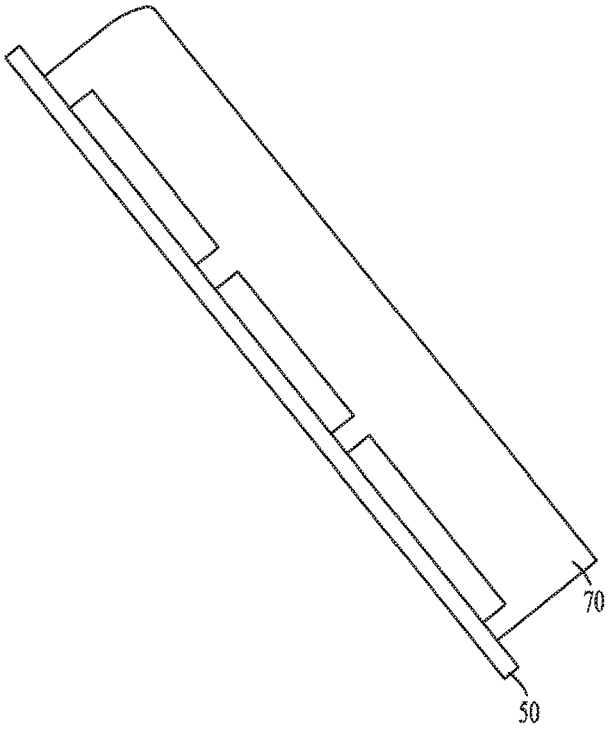
FIG. 11 is a side view of the spacer member of FIG. 9.
Figure 12:
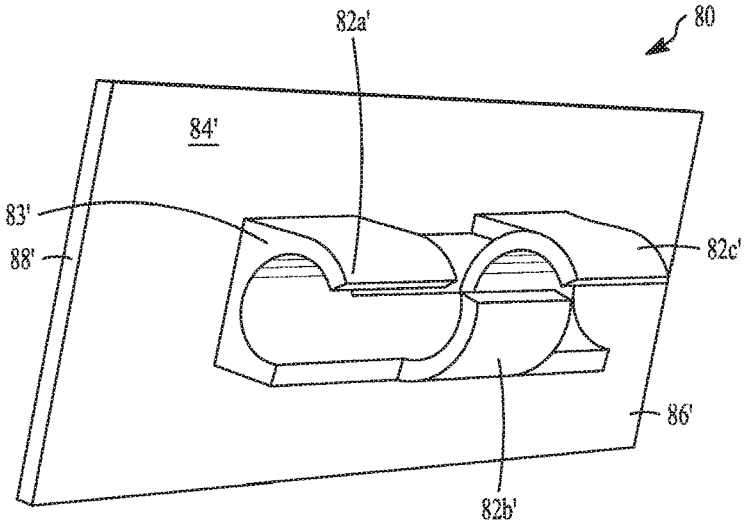
FIG. 12 is perspective view of a second embodiment of an appliance attachment mechanism as disclosed herein.
Figure 13:
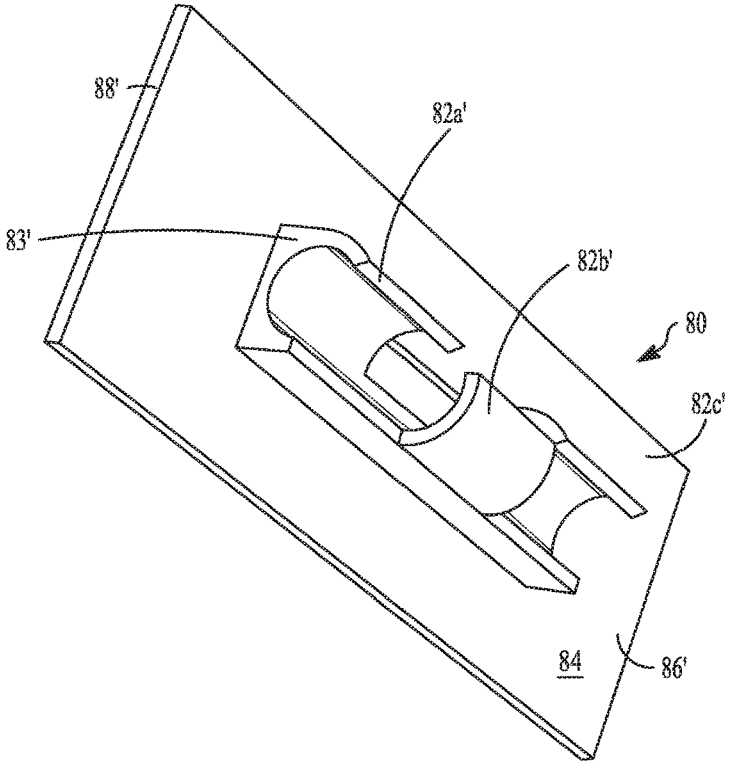
FIG. 13 is an alternate perspective view of the appliance attachment mechanism of FIG. 12.
Figure 14:
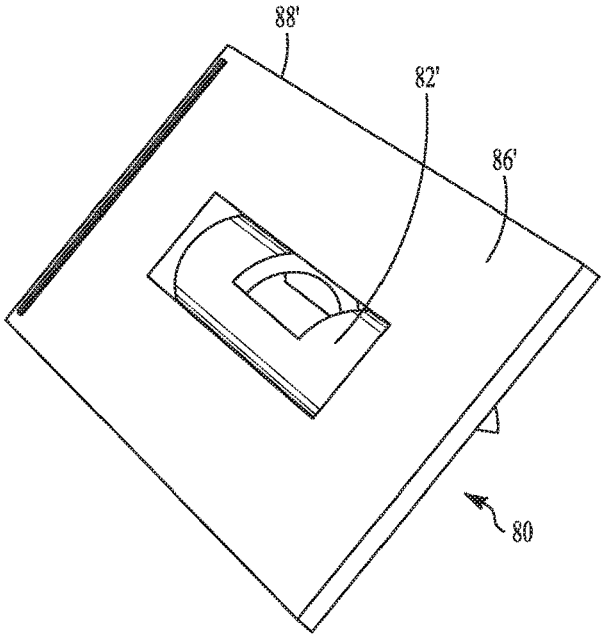
FIG. 14 is a rear perspective view of the appliance attachment mechanism of FIG. 12.
Figure 15:
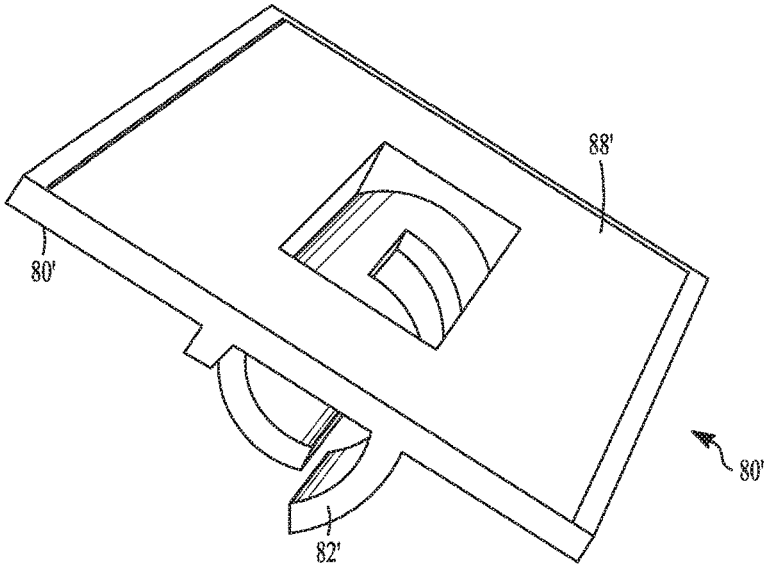
FIG. 15 is an alternate rear perspective view of the appliance attachment mechanism of FIG. 12.

An alternate embodiment of the spacer member 50 as disclosed herein is depicted in FIGS. 9, 10 and 11 in which central body 52 has a rectilinear configuration and apertures 58 have beveled edges 59 that extend from the outwardly oriented face 54 to the inwardly oriented face 56.

In the embodiment depicted in FIGS. 9,10 and 11, the rotational attachment mechanism 70 is configured as an assembly of alternately oriented curved members 90*a*, 90*b*, 90*c* that extend outward from the outwardly oriented face 54 of spacer member 50 to terminate at a distance distal thereto. Each curved member 90*a*, 90*b*, 90*c* has a side wall 92 that extends outward from the outwardly oriented face 54 and terminates in a partial arc region 94 which, as illustrated is a quarter arc. The side wall 92 and arc region 94 for each curved member 90*a*, 90*b*, 90*c* each define an associated member opening. The respective curved members 90*a*, 90*b*, 90*c* are oriented such that one of the curved members 90*a*, 90*b*, 90*c* is oriented such that the opening defined in one of the curved members 90*a*, 90*b*, 90*c* is directed toward edge 74 while the opening defined in the remaining curved members is directed toward the region of the spacer member 50 having the apertures 58. The outermost curved members 90*a*, 90*c* can also include side walls 96.

The alternate embodiment of spacer member 50 as illustrated in FIGS. 9, 10 and 11 can releasably receive a suitably configured appliance mounting member 80'. Appliance mounting member 80' includes a plurality of mating mounting members 82' that project from a first face 84' of an appliance mounting body 86'. It is contemplated that suitable appliances can be mounted to the second opposed face 88' of the mounting body 86'. Non-limiting examples of such appliances can include scrubbing pads, abrasive members and the like.

Figure 16:
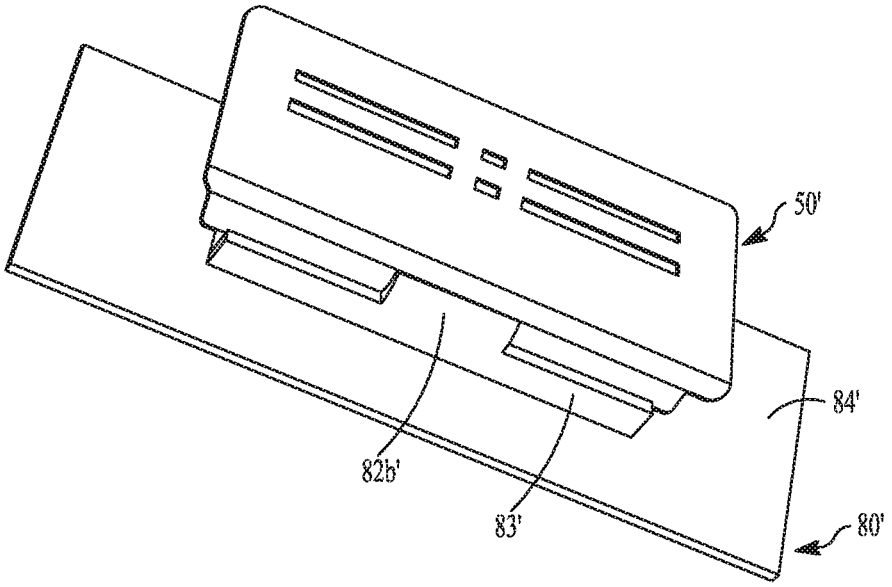
FIG. 16 is perspective view of an assembly composed of the spacer member of FIG. 9 and the appliance attachment mechanism of FIG. 12.
Figure 17:
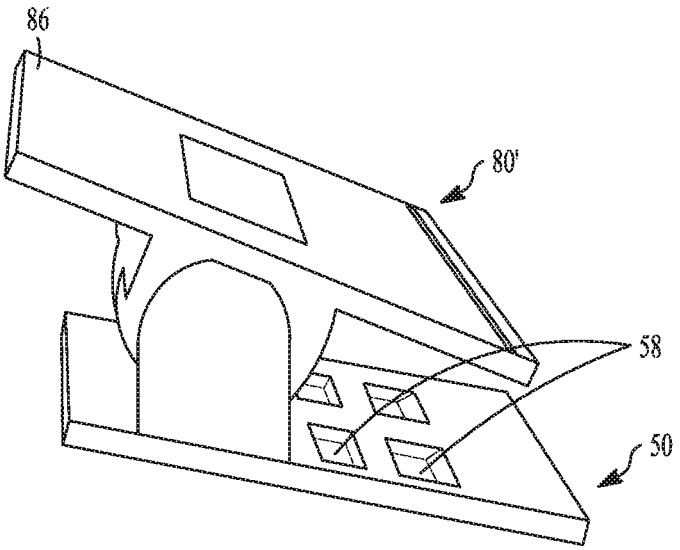
FIG. 17 is a side view of the assembly of FIG. 16.
Figure 18:
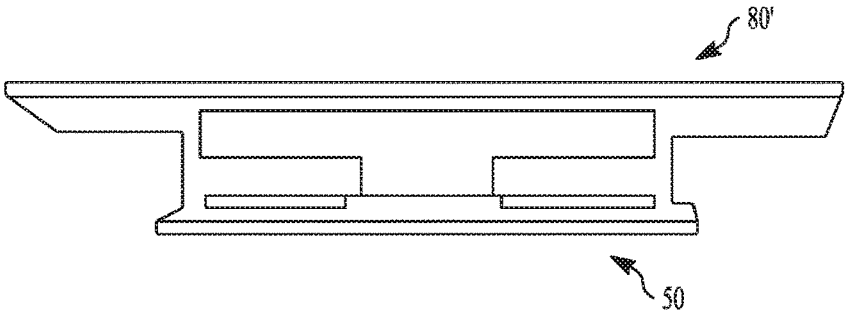
FIG. 18 is a rear view of the assembly of FIG. 16.

The mating mounting members 82' are formed as a body 83' that is contiguously attached to the body 86' of the appliance mounting member 80'. The mating mounting members 82' include three curved elements 82*a*', 82*b*' and 82*c*' that are configured to be receivably engaged in the and rotationally engage the curved members 90*a*, 90*b*, 90*c* defined on the spacer member 50 in the manner depicted in FIG. 16

The design features of the spacer member 50 serve as a multi-faceted device mechanism. The primary feature of the spacer member 50 positioned on mop head 26 is to resist excessive wear on the material of head band 30 which causes premature deterioration of the mop head 26. This wear is caused by either micro or macro movement of the head band 30 of mop head 26 while it is being held in the confines of the mop handle connection device 12 attached to the end of a mop handle 17. Since there is no current mechanism to allow for repeated positioning of the mop head 26 and the mop handle 17 other than those mops configured with a plastic threaded shell whereby a mop handle is threaded into the end of the cap affixed onto the mop itself. This design makes the mop bulkier/heavier and more difficult to launder cleanly due to the added weight.

The wear movement experienced is due to the action of dissimilar materials one of which is typically a hard plastic or metal material in the jaw members 22, 22' of the connection member 12 which connects the mop head 26 to the handle and the other is the softer material such as a canvas or mesh employed in headband 30 that is typically wrapped around the center of the strand bundle 26 of mop head 12. The wear movement causes accelerated tears and rips in the softer materials. This wear movement and the resulting wear results in quicker degradation of the softer material in the headband 30 over use.

The design concept of the spacer member 50 is to securely hold the jaw members 22, 22' of the mop handle connection member 12 onto engagement with the softer material of the headband 30 mop and reduce any movement of the mop head 12 relative to the jaw members 22, 22' and thereby slow the process of wear on the mop itself. This spacer member 50 also limits the amount of travel on the mop headband 30 and helps align the strand bundle 26 of the mop and mop handle connection member 12 so the respective members always comes together in the same general area.

Another feature of the spacer member 50 and the associated mop device 10 as disclosed herein is the ability to mount other cleaning items onto the mop device 10 itself in order to be able to perform multiple tasks in a single operation. For example, a scrub pad attachment attached to the appliance mounting member 80, 80' would allow for normal mopping action along with the agitation action of the scrub pad thereby eliminating multiple tools and steps required to thoroughly clean a floor surface.

These additional features can also include attachment of other items such as a wiper/squeegee which would operations in which the mop acts to apply the cleaning solution to the floor while the wiper blade/squeegee would assist in moving the excess water back into the mop or down a drain thereby reducing the amount of fluid on the floor in order to prevent hazardous slippery conditions and allow the floor to dry faster with less moisture on the surface.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A mop device comprising:

a plurality of yarns collected in a bundle, the bundle having a first end and an opposed second end;

at least one headband connected to the yarn bundle at a location intermediate between the first end and the second end of the yarn bundle;

at least one spacer member connected to the at least one headband in overlying relationship thereto, the spacer member having a central body, the central body having a first face and a second face opposed to the first face, and has at least one aperture defined in the central body, the aperture extending from the first face to the second face, the aperture extending through the at least one associated headband.

2. The mop device of claim 1 further comprising:

a mop handle member, the mop handle member having an elongated shaft having a first and second end opposed to the first end; and at least one mop bundle attachment mechanism connected to either the first or the second end of the elongated mop handle, wherein the attachment mechanism is configured to communicate with the at least one aperture defined in the spacer member.

3. The mop device of claim 2 wherein four spacer members are connected to the associated headband and wherein at least two of the spacer members have the apertures configured therein, said at least two spacer members having apertures defined therein in contact with the attachment mechanism located on the mop handle.

4. The mop device of claim 2 wherein the attachment mechanism of the mop handle member includes at least two jaw members, wherein the jaw members each include a leading edge and the respective leading edges each include a region that communicates with the at least one aperture present in each respective aperture.

5. The mop device of claim 4 wherein the central bodies each have a longitudinal axis and each comprise at least two elongated apertures defined in the central body and extending from the first face to the second face, the at least two elongated apertures in each spacer member disposed in a line parallel to the respective longitudinal axis.

6. The mop device of claim 4 wherein the central bodies each has a pair of elongated aperture sets disposed symmetrically to one another, wherein each elongated aperture set has at least two elongated apertures defined in the central body and extending from the first face to the second face, the at least two elongated apertures dispose in a line parallel to the longitudinal axis.

7. The mop device of claim 1 wherein the central body of the spacer member has a longitudinal axis and wherein the at least one aperture defined in the central body of the spacer member is elongated and located at a position parallel to the longitudinal axis, the spacer member further comprising at least one appliance mounting member, the appliance mounting member projecting outward from the first face of the central body of the spacer member and rotational thereto.

8. The mop device of claim 7 wherein the spacer member further comprises a rotational mounting mechanism, the rotational mounting mechanism configured to releasably contact the at least one appliance mounting member having a plurality of latch members projecting outward from the first face of the central body of the spacer member, the plurality of latch members configured to releasably engage the appliance mounting member.

9. The mop device of claim 8 wherein the appliance mounting member further comprises one tool mounted to a face of the appliance mounting member opposed to the rotational mounting mechanism wherein the at least one appliance is; a scrub brush, a scrub pad, a wiper member.

10. A device for attachment to a headband of a mop bundle, the device comprising:

a central body member having central region, a first face and an opposed second face and a least one aperture defined in the central region of the central body member, the at least one aperture extending from the first face to the opposed second face; and at least one headband attachment member, the at least one headband attachment member connected to one of the first face or opposed second face of the central body, the at least one headband attachment member configured to position the at least one first face or opposed second face in overlying contact with the at least one associated headband of the mop bundle, wherein the central body member is in overlying contact with the headband of the mop bundle and the central aperture provides communication with a covered region of the headband when the central body is in a use position.

11. The device of claim 10 wherein the central body includes a at least one through piercing extension configured to project into the associated headband.

12. The device of claim 10 wherein the central body has a longitudinal axis and comprises at least two elongated apertures defined in the central body and extending from the first face to the second face, the at least two elongated apertures dispose in a line parallel to the longitudinal axis.

13. The device of claim 10 wherein the central body has a pair of elongated aperture sets disposed symmetrically to one another, wherein each elongated aperture set has at least two elongated apertures defined in the central body and extending from the first face to the second face, the at least two elongated apertures disposed in a line parallel to the longitudinal axis.

14. The device of claim 10 further comprising at least one appliance mounting member, the appliance mounting member connected to the first face of the central body and extending outward therefrom.

15. The device of claim 10 further comprising at least one rotational attachment member, the rotational attachment member contiguously connected to the first face of the central body member.

16. The device of claim 15 wherein the rotational member comprises a plurality of latch members, wherein each respective latch member defines an interior slot, the interior slot configured to engage a mating member, the mating member associated with at least one appliance mounting member.

17. The device of claim 10 wherein the central body includes at adhesives, overlying at least one face of the central body.

18. A mop device comprising:

a mop head bundle, the mop head bundle having:

a plurality of yarns collected in a bundle, the bundle having a first end and an opposed second end;

at least one headband connected to the yarn bundle at a location intermediate between the first end and the second end of the plurality of yarns; and an attachment device, the attachment device having:

a central body member having central region, a first face and an opposed second face and at least one aperture defined in a central the central region of the central body member, the at least one aperture extending from the first face to the opposed second face; and at least one headband attachment member, the headband attachment member connected to one of the first face or opposed second face of the central body, the headband attachment member configured to position the at least one first face or opposed second face in overlying contact with the headband of the mop bundle, wherein the central body member is in overlying contact with the headband of the mop head bundle and the central aperture provides communication with a covered region of the headband when the central body is in a use position.

19. The mop device of claim 18 wherein the headband includes a first planar region and a second planar region in spaced, overlying parallel relationship to one another, wherein the yarn bundle is interposed between the first and second planar regions, the first and second planar regions each have outwardly facing surfaces and wherein the attachment device is connected to the outwardly facing surface of one of the first or second planar regions such that the headband is interposed between the yarn bundle and the attachment device.

20. The mop device of claim 18 wherein the at least one aperture defined in the central body member of the attachment device communicates with a throughbore that extends from the first face to the opposed second face, wherein the throughbore communicates with the outwardly facing surface of the headband when in the use position.

21. The mop device of claim 18 further comprising:

a mop handle member, the mop handle member having a first end and a second end opposed to the first end; and at least one mop bundle attachment mechanism connected to either the first or the second end of the elongated mop handle member, the attachment mechanism having at least one region that is in releasable contact with the attachment device when in the use position.

* * * * *